United States Patent [19]

Godinet

[11] Patent Number: 4,586,709

[45] Date of Patent: May 6, 1986

[54] CUP STACKING GAME APPARATUS

[76] Inventor: Wayne P. Godinet, 1717 Kraft St., Oceanside, Calif. 92054

[21] Appl. No.: 643,454

[22] Filed: Aug. 23, 1984

[51] Int. Cl.[4] ..... A63B 71/02

[52] U.S. Cl. ..... 273/86 R; 206/315.1; 224/268; 224/269

[58] Field of Search ..... 273/86 R; 206/546, 499, 206/500, 505, 515, 516, 517, 315.1; 224/253, 268, 269; 73/426

[56] References Cited

U.S. PATENT DOCUMENTS

| | | | |
|---|---|---|---|
| 1,755,666 | 4/1930 | Schaal | 206/517 |
| 2,291,755 | 8/1942 | Pierce | 206/517 |
| 2,530,124 | 11/1950 | Kieckhefer . | |
| 2,623,633 | 12/1952 | Bladow | 206/509 |
| 3,788,487 | 1/1974 | Dawson | 206/499 |

FOREIGN PATENT DOCUMENTS 1579133 11/1980 United Kingdom .

*Primary Examiner*—Anton O. Oechsle
*Attorney, Agent, or Firm*—Duane C. Bowen

[57] ABSTRACT

Nested cups, for playing a cup stacking game, secured to a belt loop by a retainer having a stem extending through aligned bottom openings in the cups, an enlarged retainer end inside the lowermost cup, an opening in the upper end of the stem, and a double swivel hook having a first hook secured to the opening in the stem and a second hook secured to the belt loop.

7 Claims, 5 Drawing Figures

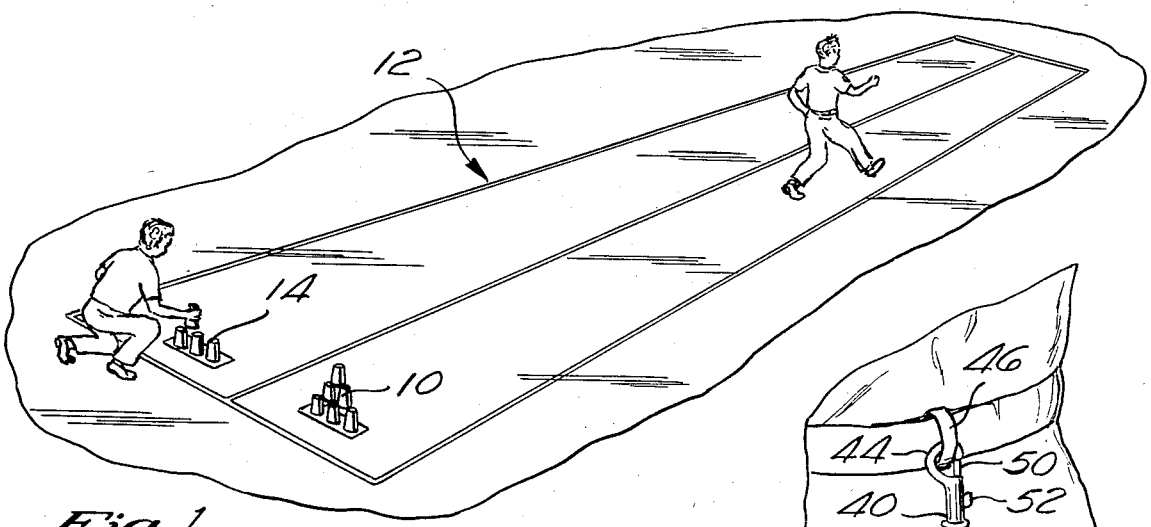
Fig. 1
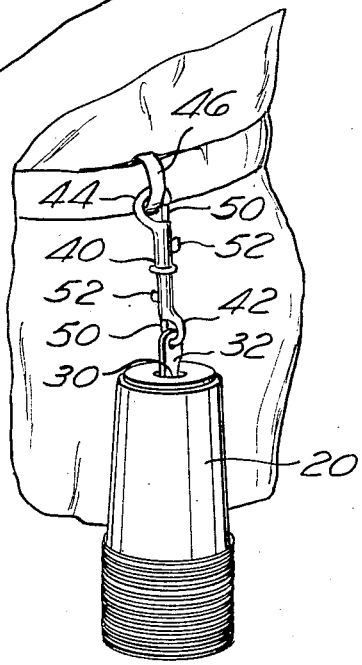
Fig. 2
Fig. 3
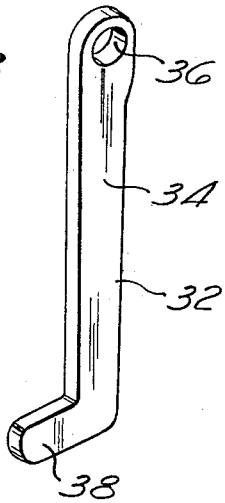
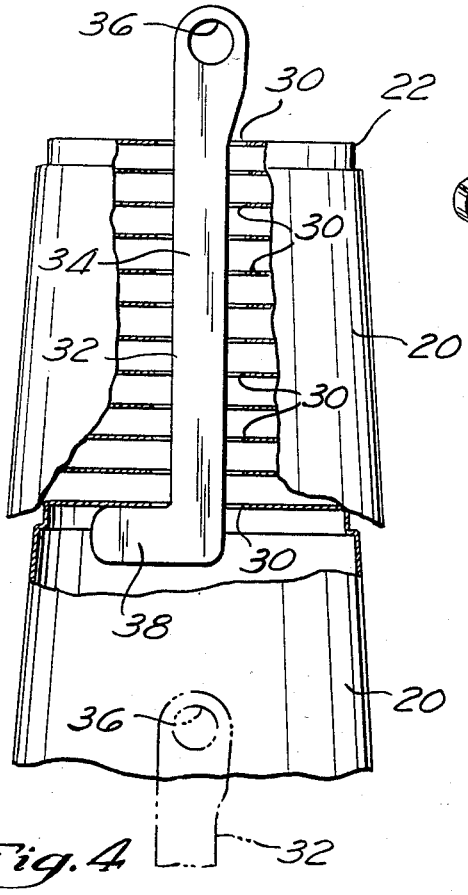
Fig. 4
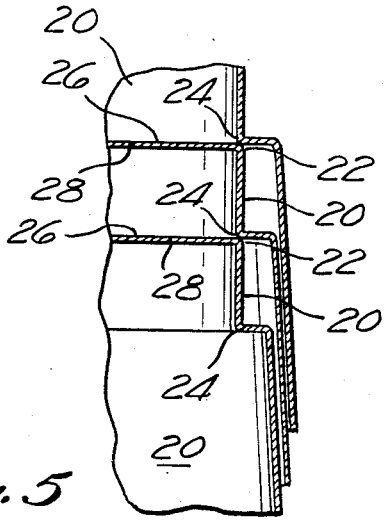
Fig. 5

CUP STACKING GAME APPARATUS

BRIEF SUMMARY OF THE INVENTION

BACKGROUND AND OBJECTIVES

My invention relates to cup stacking game apparatus adapted to be carried on a belt loop or the like.

Cup stacking games (cups stacked inverted in pyramids) have been developed for youths involving usually two or more persons competing against each other individually or in teams or relays. Commonly, a stack of cups involves three cups (two on the first course and one on the second course) or six cups (three on the first course, two on the second course and one on the third course). One stack of six cups and two stacks of three cups is another possibility. The stacking can be on the floor or tables inside or on the ground outside. In one type of competition, the player can stack in one location and race to another location to stack a second time. Unstacking may be involved as well as stacking. Such games are fun, are exciting, involve good exercise, are easy to learn, increase hand-eye coordination, and involve hand quickness, and involve technique development. The levels of skill that can be developed are quite surprising.

The present invention concerns the problem of transporting the cups from place to place. If a youth carries a bag of marbles or a yo-yo in his pocket, then he is ready to play at any time. Cups are awkward to carry. A minimum to carry would be six cups. Preferably, twelve cups are carried, which permits being a player in a game requiring twelve cups each or to play with another person without cups in games involving six cups each. Twelve ounce cups are of good size (made of paper or preferably of more durable plastic). It is an objective of my invention to solve the problem of convenient carrying of cups by youths.

A nest of twelve cups, with only minor separation between cups, will be about six and one-half inches high, in preferred twelve ounce cups each about four and a quarter inches high. If broad-brim type cup separation were instead involved with around nine-sixteenths inch runs, the total nested stack would be about ten inches or more even in 189 ml. (6.4 oz.) cups which is considered too high and is not preferred. The twelve ounce $4\frac{1}{4}''''$ cups size is a good size for playing cup stacking games.

It will be understood that even the six and one-half inch stack would be difficult to carry. An objective of my invention is to devise a convenient, economical, practical way to hold such a stack of nested cups together for transportation and preferably to permit snapping the secured stack to a belt loop, a belt, a shoulder strap of a back pack, a purse loop, etc., similarly to how children carry their home latchkeys.

My invention will be best understood, together with additional advantages and objectives thereof, when read with reference to the drawings.

THE DRAWINGS

FIG. 1 is a perspective view of players engaged in a cup stacking game.

FIG. 2 is a perspective view according to my invention of a stack of cups, of securing means, and of a device securing the cups to the belt loop of trousers.

FIG. 3 is a perspective view of a cup securing element. FIG. 4 is an elevational view, partly in section, of the method of cup securing.

FIG. 5 is a partial sectional view showing means separating cups.

DESCRIPTION

I have described above some games in the nature of cup stacking. FIG. 1 illustrates a couple of players. One player has completed a stack of cups 10 and is running to the other end of a playing course 12, to set up another stack, or to touch and return to unstack, etc. The other player is still building a stack 14. The cups are inverted and stacked in pyramidal courses, either two courses or three courses usually.

As before indicated, a preferred size for cups 20 is twelve ounce, about four and one-quarter inches high. A nest of twelve cups, with only minor separation between cups, can be about six and one-half inches. The cups 20 illustrated in FIG. 2 have narrow brims. I am not an expert on design and manufacture of plastic and paper cups, of disposable or advertising quality, but apparently cup separation is accomplished by abutment of run structure and or base structure. FIGS. 2 and 5 illustrate an applicable type of cup with only minor separation in nesting which is accomplished by base corners 22 of inner cups abutting against base shoulders 24 of outer cups, if I correctly understand the cup constructions. If cups were fully nested, i.e., inner cup base 26 pressing against abutting outer cup base 28, then the cups would not want to easily separate because of friction, cohesion, pulling a vacuum, etc. As before stated, I am not expert on design and manufacture of disposable or advertising quality paper or plastic cups, but I desire two cup features:

(a) nesting in a way that the cups are very easily separated by the players with minimum interference by friction, cohesion, or vacuum, and (b) nesting with minimum separation so that twelve cups can nest in, for example, about six and one-half inches rather than, for example, about ten inches or more with broad brim cups.

In my preferred construction, cups 20 have central aligned openings 30 in their bases. Openings $\frac{5}{8}''$ in diameter are suitable. I consider carrying nested cups in inverted positions to be preferable. A retainer 32 is provided that can be molded of plastic. Retainer 32 has a stem 34 extending through aligned openings 30. Retainer 32 has an opening 36 located above the uppermost cup, as shown in FIG. 4. Retainer 32 also has an enlarged lower end 38, too large to pass through the bottom central opening 30. A good way to provide an enlarged lower end 38 is to form retainer 32 in an L-shape, as shown, with the enlarged lower end 38 being the base of the L. The construction of retainer 32 shown is both effective and economical to manufacture.

With some type of fastener engaged in opening 36 which is too large to pass through top opening 30, the nested cups 20 would be secured together for transportation. However, it is desired to go farther than merely to secure the nested cups. An objective is to make it easy for a youngster to carry the cups with him to school, play, etc. To that end, I use a double swivel hook 40 with a first hook 42 latched in opening 36 of retainer 22 with a second hook 44 securing to the belt loop 46, belt, shoulder strap of a back pack, purse loop, etc. Hooks 42, 44 preferably have spring pressed keepers 50 operated by thumb pieces 52, to securely latch opening 36 and loop 46 or the like.

It would not be necessary for the double hooks 40 to swivel, but as double swivel hooks are used for other purposes, it may be more economical to use a general purpose double swivel hook than to specially manufacture a non-swiveling double hook or some other type of device to secure to opening 36 and loop 46. I have spent considerable time locating a source of double swivel hooks of proper size and shape and preferably formed of plastic. In fact, the first problem was to define what kind of device to use to serve my purposes. In one model, I provided a pair of registering openings in the sidewalls of cups 20 and used a hook like hooks 42, 44 to look through the pair of registered openings. Whereas that was workable, I felt it was an awkward solution.

For economy, I wanted to use commercially available, economical parts, so I regard to be able to use the commercially available double swivel hook 40, rather than a specially manufactured device, to be quite advantageous. One possibility with central bottom openings 30 in cups 20 was to have the fastener on the inside of the lower cup, but I think the design of assembly of retainer 32 and double swivel hook 40, fastening on the top of the nested cups, to be an excellent solution both from functional and price considerations. One feature I consider important is that when the cups are removed from retainer 32, the retainer can be reengaged with hook 42 to keep the parts together until the cups are to be secured again. It will be understood that youngster could lose parts if the parts were not secured together when cups were removed or if parts were not convenient to remain secured to a belt loop or the like while a game was being played.

Having thus described my invention, I do not wish to be understood as limiting myself for the exact construction shown and described. Instead, I wish to cover those modifications of my invention that will occur to those skilled in the art upon learning of my invention and which are within the proper scope thereof.

I claim:

1. Game apparatus adapted to be carried on a belt loop or the like, comprising:
   (a) at least six identical inverted cups nested in upright series one inside another,
   (b) said cups having aligned bottom central openings,
   (c) a retainer having a stem extending through said aligned openings and having an upper outer end with an opening therethrough located outside the outermost cup and having an enlarged lower inner end too large to pass through said bottom central opening located inside the lowermost cup, and
   (d) a double hook member having a first end hook latching in said opening in said stem to latch said retainer and supporting said cups and retainer in depending position, said double hook member having a second end hook to secure to a belt loop or the like of a user for transportation.

2. The subject matter of claim 1 in which there are twelve cups stacked in series, in which said hook member is a swivel hook and in which said retainer has an L-shape with said enlarged lower end being the base of the L.

3. Game apparatus adapted to be carried on a belt loop or the like, comprising:
   (a) at least six identical cups nested in upright series one inside of another,
   (b) said cups having aligned bottom central openings, and
   (c) a retainer having a stem extending through said aligned openings, said retainer having an upper outer end and a lower inner end and said lower inner end having enlarged retaining means too large to pass through said bottom central openings and said upper outer end having securing means connected thereto operative to secure said retainer to a belt loop or the like of a user for transportation.

4. The subject matter of claim 3 in which said securing means includes a hook to secure to the belt loop of a user having a spring-pressed keeper.

5. The subject matter of claim 3 in which said cups have spacer means limiting nesting of the same so as to facilitate release one from another.

6. Game apparatus adapted for transportation thereof, comprising:
   (a) at least six identical inverted cups nested in upright series one inside another,
   (b) said cups having aligned bottom central openings,
   (c) a retainer having means extending vertically through said aligned openings and securing said cups together, and
   (d) securing means connected to the upper end of said vertically extending means operative to secure said retainer to a belt loop of a user for transportation.

7. Game apparatus adapted for transportation thereof, comprising:
   (a) at least six identical inverted cups nested in upright series one inside another,
   (b) said cups having aligned openings,
   (c) a retainer having means extending through said aligned openings and securing said cups together, and
   (d) a double hook having a first hook secured to said retainer and a second hook to secure the assembly to a belt loop or the like.

* * * * *